United States Patent [19]

Van Pelt

[11] 4,392,904

[45] Jul. 12, 1983

[54] SCULPTURED LAMP BASE

[76] Inventor: Gregory A. Van Pelt, 634 Wenonah Ave., Oak Park, Ill. 60304

[21] Appl. No.: 225,009

[22] Filed: Jan. 14, 1981

[51] Int. Cl.[3] ..... B65H 81/00

[52] U.S. Cl. ..... 156/194; 156/304.2; 264/258; 428/35

[58] Field of Search ..... 156/194, 304.2, 172, 156/195, 184; 264/257, 258, 271.1; 428/31; 362/806

[56] References Cited

U.S. PATENT DOCUMENTS

| | | | |
|---|---|---|---|
| 1,518,122 | 12/1924 | Twiss | 156/194 X |
| 1,654,208 | 12/1927 | Biggs | 156/194 |
| 3,053,726 | 9/1962 | Larson et al. | 156/304.2 |
| 3,743,563 | 7/1973 | Craig | 156/290 X |
| 4,007,075 | 2/1977 | McClain et al. | 156/194 X |

*Primary Examiner*—David A. Simmons
*Attorney, Agent, or Firm*—Brezina & Buckingham

[57] ABSTRACT

A sculptured lamp base suitable for electric lamps is provided by utilizing a tightly-wound spiral of corrugated cardboard strip which is distended along a dimension parallel to its axis through forming upon a mold. The resulting sculptured lamp bases are capable of an infinite variety of shapes. Various components may be formed through utilization of this method and joined to form additional compound and return curves.

3 Claims, 4 Drawing Figures

FIG. 1
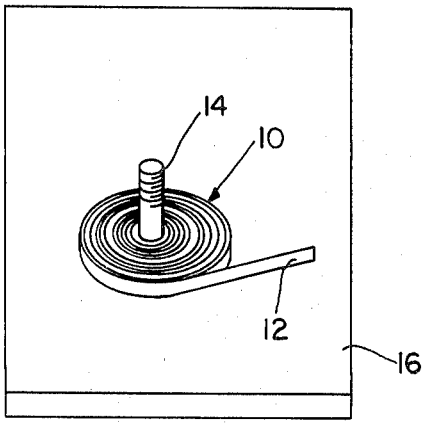
FIG. 3
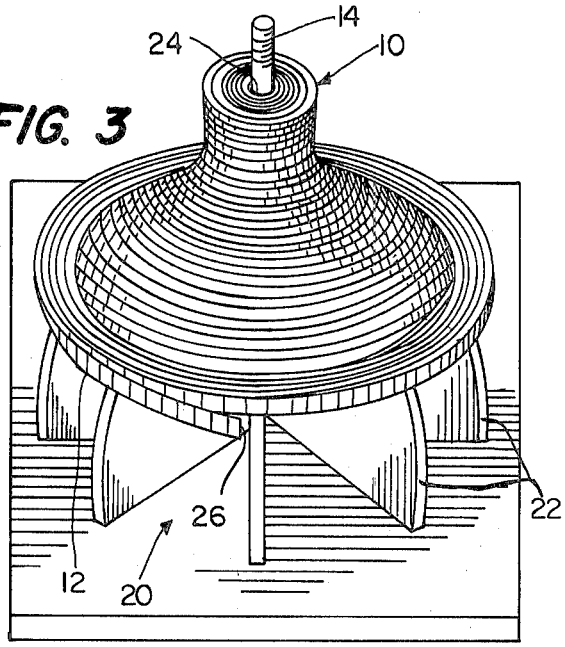
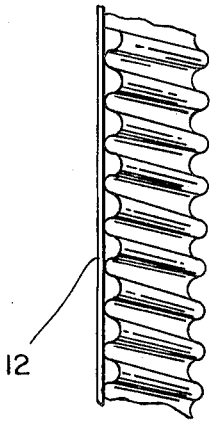
FIG. 2
FIG. 4
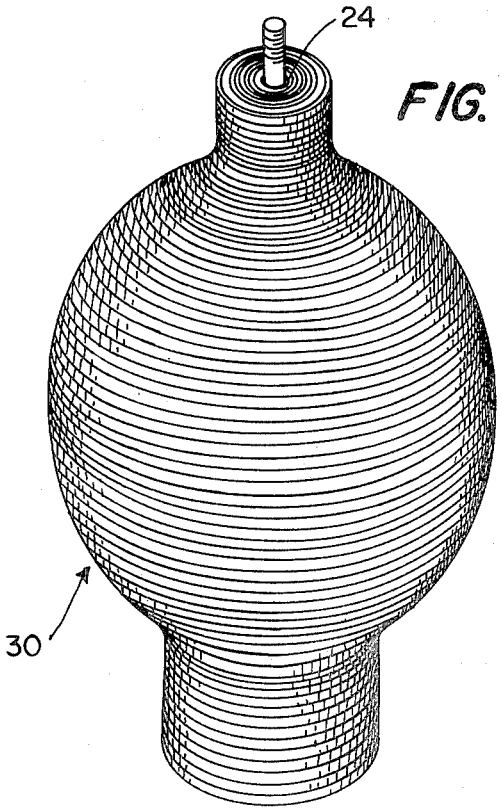

SCULPTURED LAMP BASE

This invention was evolved with the general object of providing a sculptured lamp base which is inexpensive in construction while being both light in weight and durable and providing for effective support of electric lamp hardware and conduits for appurtenant wiring.

Another object of the invention is to provide a method of construction of sculptured lamp bases which are capable of formation in an infinite variety of shapes within the limits of the method of production through the use of molds and combination of components formed according to the method.

Another object of the invention is to provide for a method of production of inexpensive sculptured lamp bases which may be manufactured with a high degree of uniformity through the utilization of common molds.

In accordance with this invention, a spiral strip of corrugated cardboard is formed through the winding of said strip around a central core threaded or otherwise designed for the later attachment of lamp hardware to be formed into the desired shape. The prepared tightly-wound spiral is then distended along a dimension approximately parallel to the axis of the winding of said spiral. The corrugated cardboard is particularly desirable in that it provides both a flexibility in its winding when wound with the corrugations parallel to the axis of winding while also providing for lateral stiffness and further forming because of the regular dimensions of the corrugations laterally, a pleasing pattern and appearance in the finished product, utilizing the tightly wound coil or spiral of corrugated strip.

In accordance with a specific feature, the spiral prepared is made from a pre-slit strip of single wall corrugated cardboard with an optimal width of approximately $\frac{3}{4}$ of one inch, although the width may be as little as $\frac{1}{4}$ of an inch.

In accordance with another specific feature, the forming of the spiral of corrugated strip requires winding at the appropriate tension in order to facilitate the optimal structural strength while facilitating the distention along the vertical axis. In keeping with the necessity for a proper tension, tension is added both during and following winding. In keeping with the requirement for the proper tension, once winding is completed an additional procedure of pulling out the slack through final tensioning is also accomplished.

In accordance with another feature of the invention, molds are used which comprise a plurality of fins or ribs arranged to create eight vertical arms or ribs mounted on a horizontal base standing in approximately 45 degrees in relationship to each other, said forms constituting in their vertical cross-section a shape approximately equal to that of the internal and external dimensions of the finished sculptured lamp base.

In accordance with another specific feature, the second mold constructed in the manner of the first is used for shaping of the external dimensions of the sculptured lamp base and is used for the creation of compound curves which require first a formation through the distention against the primary mold in one direction, and then the subsequent distention in the secondary mold in the opposite direction, while preserving the curves created in the primary mold.

In accordance with another specific feature, the invention utilizes molds whose dimensions have been designed to form upper and lower sections of the finished sculptured lamp base where the turn curves as in the construction of the sphere from two hemispheres are to be formed. In addition, secondary or tertiary components are necessary where an angle or curve is desired which requires displacement of a single coil in excess of $\frac{1}{2}$ inch in either direction, or where a separate base is desired. Following the initial shaping on the mold or molds, the final finishing to smooth out the lines is accomplished.

In accordance with another specific feature, the inside of the finished formed shape is sprayed internally with a white, water-based wood glue or other appropriate adhesive. Said spraying both provides a uniform coat of adhesive which is essential in maintaining the integrity of the form, and provides for the permanent maintenance of the form. In accordance with another specific feature, all joints are coated with an adhesive, such as that previously sprayed upon the inside of the formed sculptured lamp base which provides strengthening of the mounting for lamp hardware and prevents unraveling from the center of the spiral and maintains the tension and reinforces the coil structure. The outer joints are further coated with glue to maintain the tension upon the coil which reinforces the coil structure. The joints where one hemisphere is formed to mate internally with another hemisphere must be fixed with an appropriate degree of precision to provide for said mating.

In accordance with another specific feature, the formed and internally glued sculptured lamp base form is given sufficient time for the glue to set. Once the internal gluing is set and the form is fixed, a second application is applied to the outer portions of the form, thereby greatly enhancing the uniform coating and permanent fixation properties of the internal gluing and enhancing the strength of the structure, and further applying a uniform and protective coating upon the outer surfaces.

In an alternative embodiment, either an asymmetric or bilaterally symmetric spiral may be formed with appropriate alterations to the mold, thereby yielding a variety in the number of finished shapes available.

In another alternative embodiment the mold itself may be altered to form bilaterally symmetric shapes on circular spirals or other asymmetric shapes, depending on the specific shape of the coil.

In another alternative embodiment, the finished shape may be coated either on one or both sides with a sheet or other solid, non-permeable coating for utilizing the shape in applications either requiring greater strength or insulating properties, or both, as well as providing greater flexibility in the external appearance of the finished form.

This invention, its objects, features and advantages will become more fully apparent from the following detailed description taken in conjunction with the accompanying drawings which illustrate a preferred embodiment in which:

FIG. 1 is a perspective view of the method of winding a strip of corrugated cardboard around a central core;

FIG. 2 is a perspective view of a section of a pre-slit strip of single wall corrugated cardboard of the type utilized in winding the spiral;

FIG. 3 is a perspective view of the spiral of corrugated strip in a state of partial distention upon a primary mold, which exhibits both the spiral and the mold in their relative positions; and FIG. 4 is a perspective view of a sculptured lamp base constructed in accordance with the invention, comprising an upper and lower section joined together.

For assembly the assembler begins with the winding of the spiral coil 10 of corrugated cardboard strip 12. The width of the corrugated cardboard strip is determined based on the desired thickness of the bottommost coil and also dependent upon the final desired shape of the sculptured lamp base. The winding is accomplished about a suitable core member 14 and upon a smooth, flat work space, such as 16, using an electric drill as a power source, or other similar power source to accomplish the winding. Tension is controlled by the speed of the winding and pressure applied by the operator. Winding is continued until the spiral of appropriate diameter has been created. Said diameter having been predetermined and set using a jig.

Once the appropriate dimensions have been reached through machine tensioning, final tensioning is applied by the assembler.

The dimensions for the mold are determined by the desired final shape of the formed sculptured lamp base. In its preferred embodiment the mold 20 comprises approximately eight vertical arms 22 around a central axis standing in approximately equal angular displacement with relationship to each other. The vertical arms of the mold may contain stops to prevent the overextension of the spiral which facilitates overextension and the removal of the formed spiral from the mold.

With the mold appropriately constructed, the assembler places the assembled spiral on the top of the mold and forces the spiral to conform to the shape of the mold. In order to accomplish the proper distension without overextending any portion of the spiral to the point of releasing the tension and thereby unwinding the spiral, the distention is accomplished by beginning with the centermost portion and extending outward. Once the primary extension is accomplished and there is no longer danger of overextension of any particular coil within the spiral, the final smoothing or shaping takes place.

In the preferred embodiment a matching or mating lower half of the finished sculptured lamp base is constructed similarly. The shape and dimensions of the lower portion of the lamp base are determined first by the necessity for the mating of the two halves of the lamp base, and second by the desired shape of the lower section of the lamp base.

Both top and bottom sections are sprayed with white, water-soluble wood glue internally which both fixes the shape of the upper and lower sections permanently and provides for structural strength. In addition to the internal spraying, additional quantities of glue are applied to the joints 24 where the spiral was wound initially around the central core and the outermost joint 26 where the end of the spiral corrugated cardboard strip is affixed to the outermost coil in the spiral. The application of extra glue at these points is desirable since these are the points most likely to suffer from the wear and tear of use and transportation of the finished product, are instrumental in maintaining the proper tension and, therefore, the relationship of all the coils to each other, and finally, the outermost end must be fixed at a constant diameter because of the necessity of the mating of the two upper and lower portions of the sculptured lamp base together.

Following the internal gluing the flue on the forms is permitted to dry. Following the drying of the internal gluing the two sections in the preferred embodiment and other sections in any additional embodiment are mated together with glue applied at the point of their contact, and the entire sculptured lamp base 30 sprayed externally with white, water-based wood glue. This increases the strength of the respective portions of the finished product and insures that the two halves remain affixed to each other.

It will be understood that modifications and variations of the described embodiment may be effected without departing from the spirit and scope of the novel aspects of the invention.

I claim as my invention:

1. In a method for the production of sculptured lamp bases, the steps comprising: winding a pre-slit strip of single wall corrugated cardboard around a central core threaded or otherwise designed for the attachment of lamp hardware to form a tightly wound spiral of a certain diameter; positioning said spiral on a mold comprising a plurality of ribs radiating around a vertical axis coincident with said central core; distending said spiral downwardly along said mold beginning with the centermost position of said spiral; tautly shaping the distended spiral to conform with the shape of the mold; applying glue to the molded spiral to the inner surfaces thereof and about the central core and the outermost edge of the spiral; repeating the prior steps to form a mating molded spiral; gluing the bottom of the first molded spiral to the top of the mating spiral; and coating the completed lamp base with glue.

2. A method according to claim 1 in which the primary and secondary molds are similarly shaped so that the first molded spiral and the mating molded spiral comprise mirror images of each other.

3. A method according to claim 1 in which the primary and secondary molds are of different shapes so that the first molded spiral and the mating molded spiral comprise different shapes to provide an asymmetrical lamp base.

* * * * *